US005088832A

United States Patent [19]

Gambrill et al.

[11] Patent Number: 5,088,832

[45] Date of Patent: Feb. 18, 1992

[54] STEADY BEARING APPARATUS FOR THE FREE END OF THE IMPELLER SHAFT OF A MIXER

[75] Inventors: Jeffrey S. Gambrill, Hilton; Dominic Borraccia, Spencerport, both of N.Y.

[73] Assignee: General Signal Corporation, Stamford, Conn.

[21] Appl. No.: 565,539

[22] Filed: Aug. 10, 1990

[51] Int. Cl.[5] ..... B01F 7/00

[52] U.S. Cl. ..... 366/314; 366/279

[58] Field of Search ..... 366/205, 279, 314, 348, 366/349, 64, 65, 285, 286, 138, 331; 384/281, 903, 906, 280, 295, 296; 403/326, 355, 356

[56] References Cited

U.S. PATENT DOCUMENTS

| | | | |
|---|---|---|---|
| 165,425 | 7/1875 | Quackenbush . | |
| 814,168 | 3/1906 | Schulz . | |
| 1,687,171 | 10/1928 | McCathron . | |
| 1,768,927 | 7/1930 | Peters | 366/264 |
| 2,245,084 | 6/1941 | Wood | 384/281 |
| 2,467,312 | 4/1949 | Jack . | |
| 2,628,081 | 2/1953 | Laird . | |
| 2,732,267 | 1/1956 | Stover . | |
| 3,345,043 | 10/1967 | Bovagne . | |
| 3,580,547 | 5/1971 | Amorese | 366/138 |
| 3,774,879 | 11/1973 | Zink . | |
| 4,138,168 | 2/1979 | Herlitzek | 384/903 |
| 4,601,590 | 7/1986 | Aril | 384/906 |
| 4,634,299 | 1/1987 | Svensson . | |
| 4,722,608 | 2/1989 | Salzman et al. . | |
| 4,875,785 | 10/1989 | Dewachter . | |
| 4,932,787 | 6/1990 | Fasano | 366/314 |

FOREIGN PATENT DOCUMENTS

| | | | |
|---|---|---|---|
| 812987 | 5/1959 | United Kingdom | 366/249 |

*Primary Examiner*—Harvey C. Hornsby
*Assistant Examiner*—Terrence R. Till
*Attorney, Agent, or Firm*—Martin Lukacher

[57] ABSTRACT

A steady bearing for the free end of a mixer shaft, which may be made from composite (fiber reinforced plastic) materials in substantial part, has a generally bell-shaped body with a neck in which the free end of the shaft or a shaft extension is disposed. A bearing assembly is removably disposed in the neck. The bearing has a bushing which is keyed to an inner sleeve around the shaft and to an outer sleeve by keyways which are open at one end so that the bushing and outer sleeve can be axially displaced for initial installation of the steady bearing and also when the bushing thereof requires replacement. When the shaft is too large to fit inside of the steady bearing. A reduced diameter shaft extension is provided to fit the steady bearing.

11 Claims, 4 Drawing Sheets

STEADY BEARING APPARATUS FOR THE FREE END OF THE IMPELLER SHAFT OF A MIXER

DESCRIPTION

The present invention relates to apparatus for supporting a mixer shaft in a mixing vessel against radial displacement while mixing material in a vessel, and particularly to steady bearing apparatus for mixer shafts wherein the shaft is composed of composite (fiber reinforced plastic) material and wherein the steady bearing is composed essentially entirely of such material.

The present invention is especially suitable for use in steadying long composite mixer impeller shafts of mixer apparatus of the type described in U.S. Pat. No. 4,722,608, issued Feb. 2, 1989 to R. Salzman, et al. Features of the steady bearing apparatus provided in accordance with the invention are generally useful in mixer apparatus, especially where features of ease of replacement of bearing assemblies, and especially bushings thereof, are desirable.

Steady bearing apparatus is often used in mixers for steadying (preventing radial displacement under fluid forces) of a mixer shaft which carries an impeller or impellers for mixing material (usually liquids or liquid suspensions) in a tank or other vessel. Steady bearings are often used when the mixer shaft is 10 to 20 feet in length (or more) from the end thereof which is driven by the mixer drive. When the shaft is made of composite material, it is desirable that the steady bearing also be made of such material that the compatibility of the mixing system with the material being mixed, because of the corrosive or other reactive nature thereof, is maintained. Composite materials, however, are not capable of withstanding mechanical forces, particularly strains, as well as metals. Reference may be had to the above mentioned Salzman, et al. patent for further information respecting the strength of composite materials. The mechanical problems engendered by the use of composite materials are exacerbated by the need for replacement of bearing components, particularly bushings, which wear during use. A still further problem is that mixer impeller shafts which must be steadied come in a variety of diameters, for example, from 3 to 10 inch diameter. It is not desirable to require different steady bearing designs for each diameter.

Accordingly, it is the principal object of the invention to provide improved steady bearing apparatus for supporting a mixer impeller shaft wherein the foregoing problems are addressed and substantially eliminated.

It is a still further object of the present invention to provide improved steady bearing apparatus of a design whereby the replacement of parts subject to wear, such as a bushing thereof, may readily be accomplished.

It is a still further object of the present invention to provide improved steady bearing apparatus requiring few parts, and particularly a body which supports the rotating parts thereof which is made of composite material, and which can be fabricated at reasonable cost.

Briefly described, apparatus in accordance with the invention is operative for supporting, in a mixing vessel, a shaft which carries an impeller of a mixer at one end of the shaft while the shaft is rotatably driven from the opposite end thereof. A body, which may be made of composite material, has a tubular neck. The bearing components are disposed within that neck and include a sleeve having an outer periphery removably attached in fixed relationship with the neck. The sleeve has an inner perimeter which presents a first bearing surface. A bushing having an outer perimeter presents a second bearing surface. The bushing has an inner periphery removably attached in fixed relationship with the mixer shaft. The bearing surfaces are disposed in contact for steadying the shaft while it rotates while the mixer impeller mixes material in the vessel, and prevents excessive shaft deflection thereof in response to fluid forces acting on the shaft. The sleeve, bushing and neck arrangement distributes forces from the shaft to the body of the steady bearing apparatus.

The foregoing and other objects, features and advantages of the invention and a presently preferred embodiment thereof will become more apparent from a reading of the following description in connection with the accompanying drawings in which.

Figure 1:
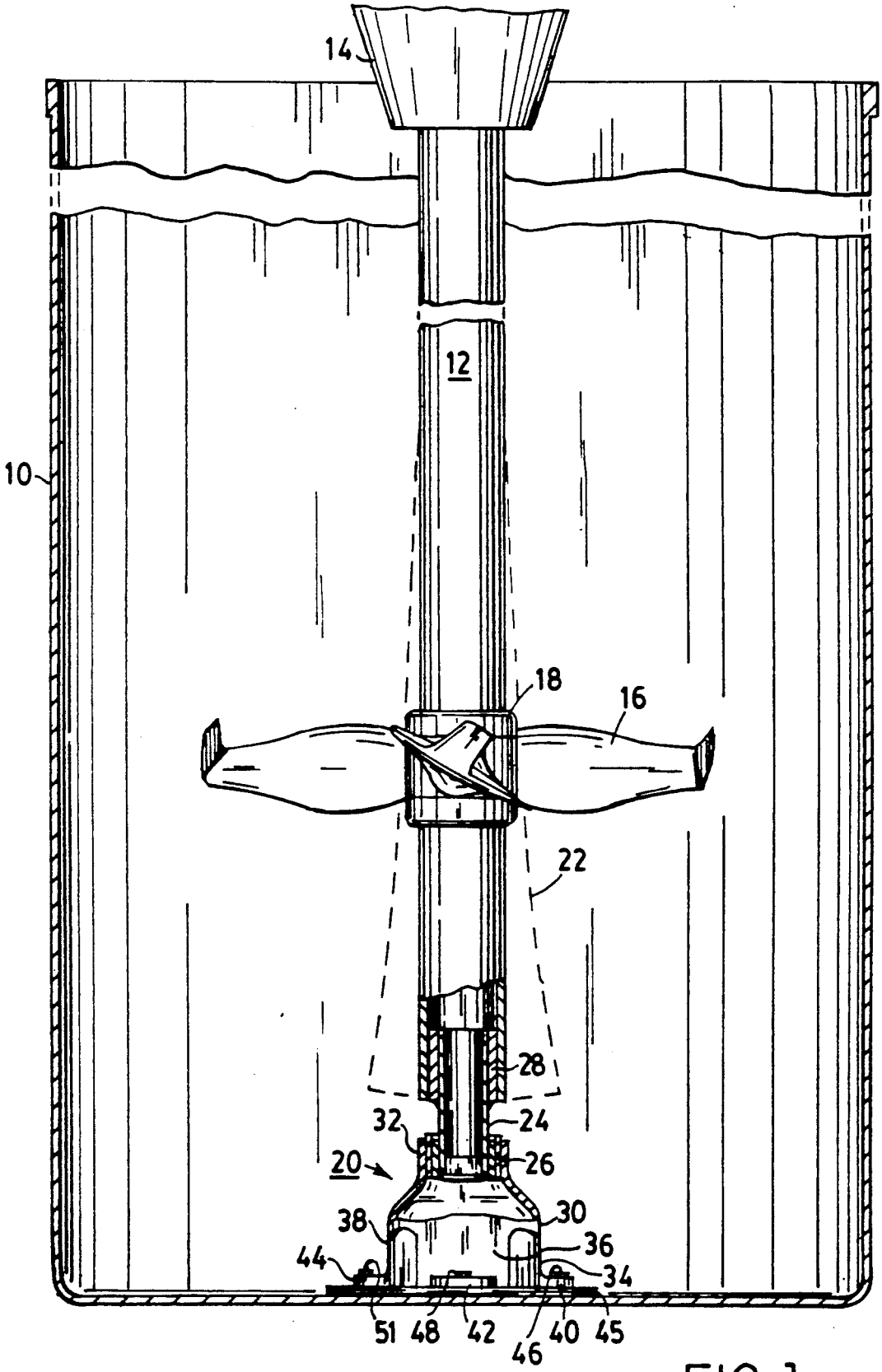
FIG. 1 is an elevational view showing in section a mixing tank, and partially in section the lower end of the mixer shaft, and a steady bearing in accordance with the invention.

Referring more particularly to FIG. 1, there is shown a tank 10. The tank is empty in the illustration, but it will be appreciated that during mixing operations the tank contains material (usually liquid or liquid suspension) to be mixed. A mixer shaft 12 extends from the quill 14 of a mixer drive. The shaft may be 10–20 feet, or more, long from the quill at one end thereof to the opposite end thereof which is near the bottom or floor of the tank 10. An impeller 16 is mounted by a hub 18 on the shaft 12. The shaft and impeller may be of the design shown in the above-referenced Salzman, et al. patent. Steady bearing apparatus 20 in accordance with the invention prevents bending of the shaft 12 during mixing operations and counteracts such bending deflections as are indicated by the dashed lines 22.

The shaft 12 in this embodiment is made of composite FRP (fiber reinforced plastic) material and is tubular. A shaft extension 24 is used which is of smaller diameter than the shaft 12 but is of a diameter adapted to be accommodated in the bearing assembly 26 of the steady bearing apparatus 20. A collar section 28 which may be a built-up winding of layers of fiber reinforced plastic (either filaments or mats of fiber impregnated with resin of the type which is commercially available) may be used to build up the collar 28. The collar is built up so that it meets the inside diameter of the tubular shaft 12 and can be connected thereto, as by with glue. In this manner, coupling to the steady bearing support is provided without requiring different sizes of steady bearing for different shaft diameters.

A shaft, for example, of 3" diameter, may be disposed without an extension in the steady bearing. For larger size shafts, for example, 4, 6 and 10" diameter shafts, collars 28 are used. This reduces the cost of providing steady bearings in mixers.

The steady bearing support is provided by a generally bell-shaped body 30 having a neck 32 in which the bearing assembly 26 is located. The body 30 is made of composite material, for example, mat layers of fiber reinforced plastic, disposed on a mandrel. The inner layers may be bi-directional lay-ups of glass fibers to provide strength. Suitably the mats may be 25% glass, and 75% resin. In this embodiment 1.5 oz. chopped strand glass mat layers are built up to 0.40 inch thickness. The corrosion barriers are two layers on all surfaces of the body and add an additional 0.100 inch thickness. The body 30 has three legs 34, 36 and 38. These legs are preferably built up with bi-directional glass mats for increased strength. Feet 40, 42 and 44 extend radially from the legs. They may rest on a pad 45 and screwed (as into tapped blind holes) in the floor of the tank by screws 46, 48 and 51. It may be desirable to insert shims under the legs in order to align the body 30 and the bearing assembly 26 so as to be plumb with the shaft 22, and the shaft extension 24, if the latter is used.

Referring to FIGS. 2 through 7, the shaft 12 is shown together with a shaft of larger diameter (in lines made up of long and short dashes). The shaft 12 may, for example, be a 4" shaft, while the shaft diameter 12A is 6" or larger. In the event that the larger diameter shaft is used, the collar 28 is built up so that it is of a size shown at 28A where it meets the inner diameter of the larger tubular shaft 12A. The lower end of the extension 24 is closed by a plug 50.

The bearing assembly 26 is contained within the neck 32 of the body 30. The neck is formed with a step 52. The bearing assembly contains an outer sleeve 54, a key 56, a bushing 58, another key 60, and an inner build-up or neck 62. The inner build-up has a flange 64 and a circular notch 66. The inner neck 62 is a sleeve built up of fiber reinforced plastlc material on the periphery of the shaft or shaft extension 24 (as shown). The inner neck 62 has a keyway 68 which extends upwardly into the inner neck but ends before reaching the upper end of the sleeve. The bushing 58 is made of bearing material such as graphite. Preferably graphite impregnated polyflourethylene (Teflon) material is used for the bushing 58. The bushing is a replaceable element and wears during operation of the bearing assembly 26. The bushing has a keyway 72 which extends from its upper end but does not reach its lower end. The bushing and the inner neck, therefore, have keyways with open and closed ends which are in overlapping relationship and capture the key 60 therein. The key 60 is a dowel pin, preferably made of Ryton plastic (polyphenylene sulfide (PPS) sold under the tradename Ryton). The bushing is captured between the step 64 and a retaining or lock ring 74 which fits into the annular notch 66 in the inner neck 62.

It will be apparent that the bushing can be removed by axially displacing it toward the closed end of its keyway 72 after the retaining ring 74 has been removed.

The bushing has an outer perimeter in engagement with the inner perimeter of the outer sleeve 54. These perimeters provide bearing surfaces. The outer sleeve 54 may be made of stainless steel or composite material. It is removably held in the neck 32 of the body 30 by an arrangement of keyways 78 and 80 in the sleeve 54 and neck 32, respectively. The sleeve 54 is captured between the ste 52 and a retaining or lock ring 82 disposed in a notch 85 in the outer periphery of the sleeve which extends axially beyond the upper end of the neck 32.

To remove the bearing assembly for replacement of the bushing 58, the retaining ring 82 is removed and the sleeve is displaced in the direction of the closed end of its keyway 78. Then the retaining ring 74 is removed and the bushing is displaced. The bushing may then be replaced with a new bushing, after which the sleeve is replaced, of course, together with their respective keys 56 and 60.

Figure 2:
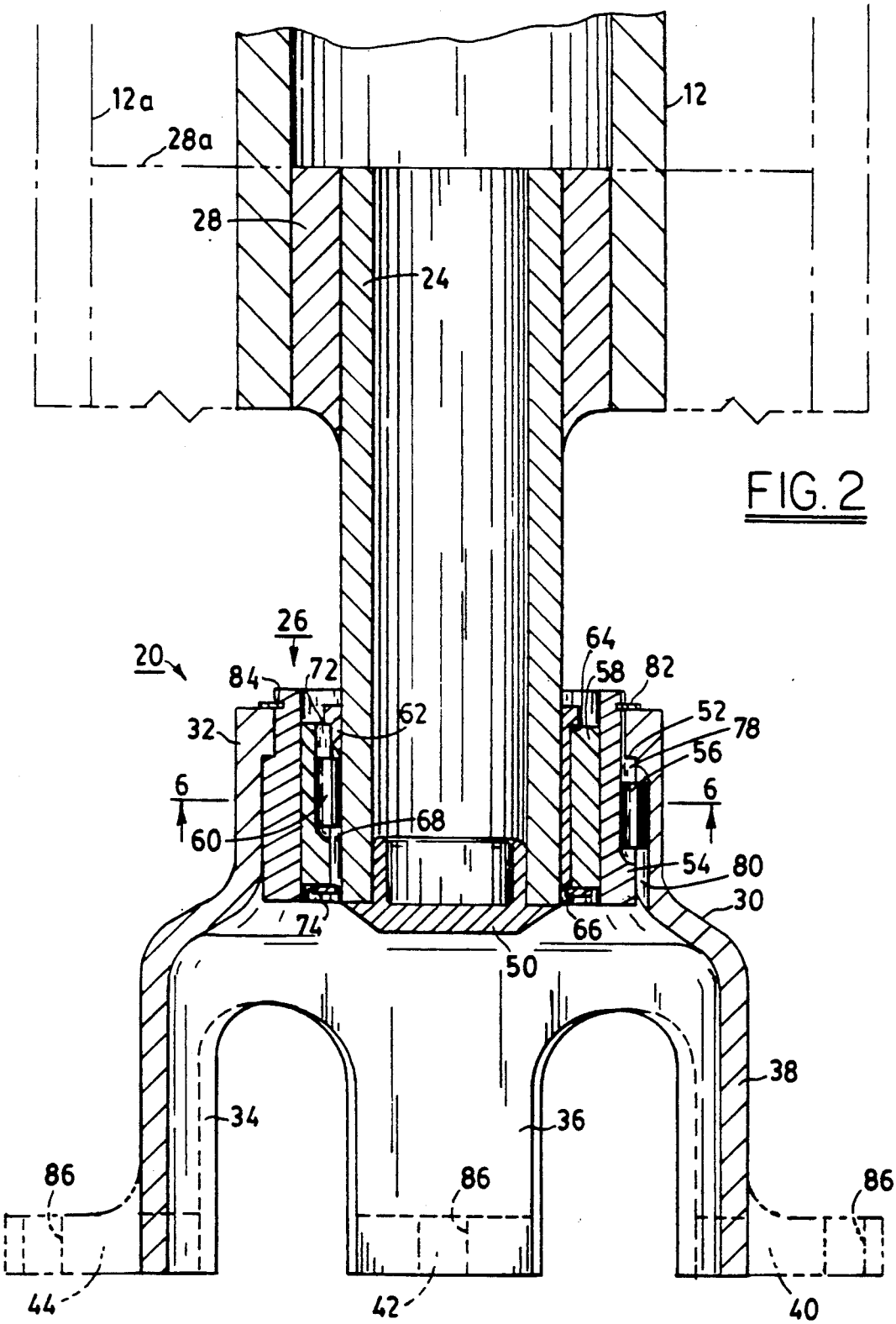
FIG. 2 is a transverse sectional view along a diameter through the steady bearing apparatus and the end portion of the mixer shaft illustrating in greater detail the steady bearing apparatus shown in FIG. 1.
Figure 3:
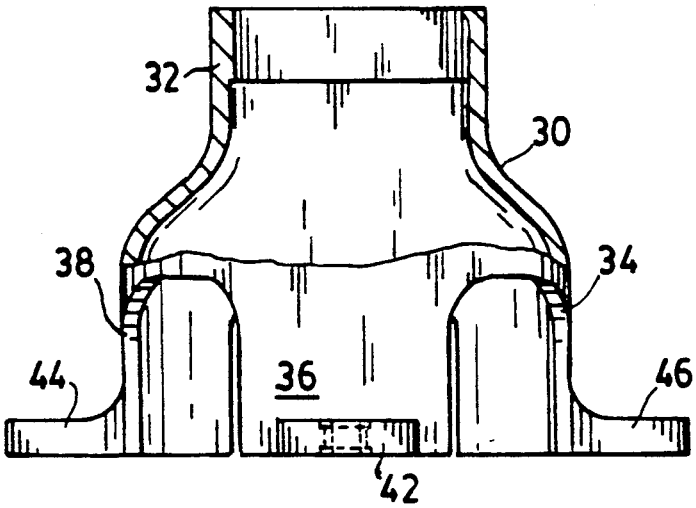
FIG. 3 is an elevational view, partially in section, of the body or bell support of the steady bearing shown in FIGS. 1 and 2.
Figure 4:
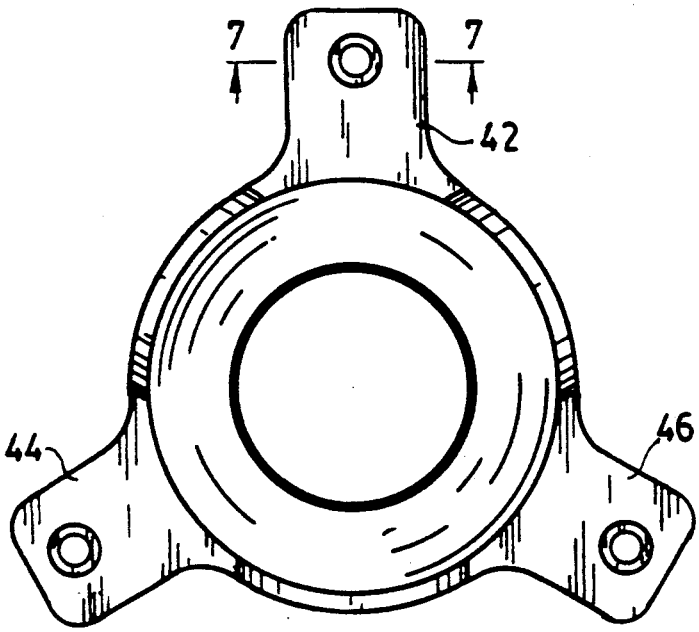
FIG. 4 is a bottom view of the body shown in FIG. 3.
Figure 5:
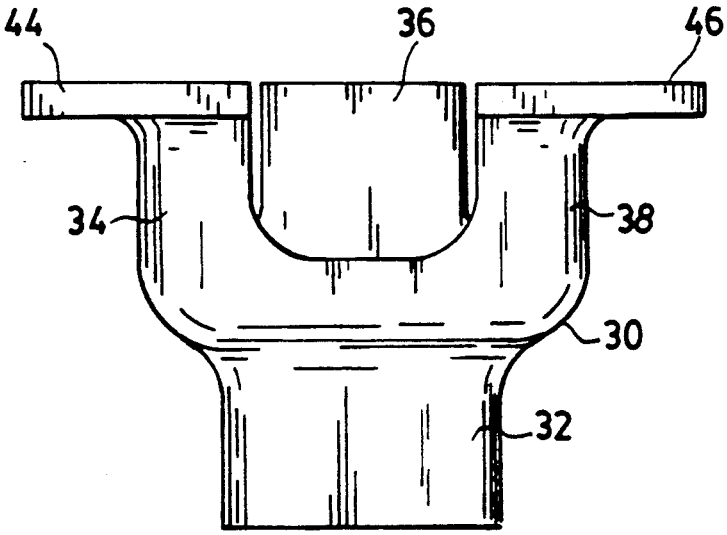
FIG. 5 is an elevational view of the body shown in FIG. 3 taken from the opposite side thereof and inverted.
Figure 6:
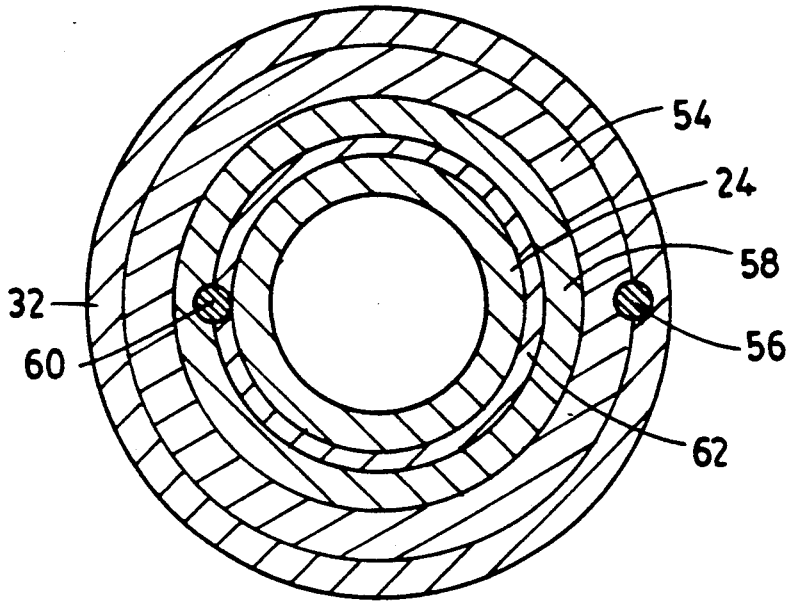
FIG. 6 is a sectional view taken along the line 6—6 in FIG. 2.
Figure 7:
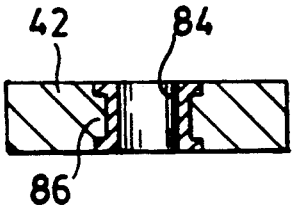
FIG. 7 is a sectional view taken along the line 7—7 in FIG. 4.

As shown in FIG. 2 and, FIGS. 3 through 5, the legs 34, 36 and 38 of the body 30 define passages for the flow of the material being mixed through the body. The feet 42, 44 and 46 are angularly offset 120° (radial lines through the center of the feet bisect the feet and their respective legs and are 120° apart). The feet have metal inserts 84 (see FIG. 7) through holes 86 to distribute forces from the clamping nuts and bolts 46, 48 and 50 (FIG. 1). The inserts 84 are formed into—the feet 46, 44, 42 during construction from the FRP material and are integral with the feet in which the inserts are located.

From the foregoing description, it will be apparent that there has been provided improved steady bearing apparatus for support of mixer shafts. While a presently preferred embodiment of the invention has been described, variations and modifications thereof within the scope of the invention will undoubtedly suggest themselves to those skilled in the art. Accordingly, the foregoing description should be taken as illustrative and not in a limiting sense.

We claim:

1. Apparatus for supporting, in a vessel, a shaft, which carries an impeller of a mixer at one end of the shaft while the shaft is rotatably driven from the end thereof opposite to said one end which comprises a body having a tubular neck, a sleeve having an outer periphery, said sleeve being removably attached in fixed relationship with said neck along its outer periphery, said sleeve having an inner periphery presenting a first bearing surface, a bushing having an outer periphery presenting a second bearing surface and an inner periphery, said bushing being removably attached in fixed relationship with said mixer shaft along its inner periphery adjacent to said one end of said shaft, said first and second bearing surfaces being disposed in contact for steadying said shaft while it rotates while said mixer mixes material in said vessel, and further comprising keyways extending axially of said shaft in said shaft and in said bushing, said keyways each having closed and open ends, a key in said keyways, said open and closed ends being disposed in axially overlapping relationship capturing said key therein and enabling removal of said bushing when axially displaced in a direction toward said closed end thereof, and a retaining ring removably disposed in said shaft in blocking relationship with said bushing for preventing displacement in said direction.

2. The apparatus according to claim 1 further comprising keyways in said neck of said body and in the outer periphery of said sleeve each having open and closed ends, a second key in said keyways of said neck of said body and sleeve, said open and closed ends of said neck of said body and sleeve being disposed in axially overlapping relationship capturing said second key in said keyways thereof and enabling removal of said second key when said sleeve is disposed in a direction toward the closed end thereof, a second retaining ring removably disposed in said sleeve in blocking relationship with said neck of said body for retaining said sleeve in said neck of said body.

3. The apparatus according to claim 1 wherein said shaft and said body consist of fiber reinforced plastic material.

4. The apparatus according to claim 1 wherein said shaft is tubular at least adjacent to said one end thereof, an extension of said shaft smaller than said shaft, said extension having an outside diameter sufficient to be received within the inner periphery of said bushing, said extension of said shaft having a collar, said collar being sufficient to increase the diameter of said extension to meet the said tubular shaft, said collar and tubular shaft being connected in fixed relationship with each other.

5. The apparatus according to claim 4 wherein said shaft consists essentially of fiber reinforced plastic and said extension also consists essentially of fiber reinforced plastic material.

6. The apparatus according to claim 1 wherein said body has a plurality of legs defining openings into said body for the circulation of said material said legs extending downward and protruding outward from the upper portion of said body to form generally a bell shape.

7. The apparatus according to claim 6 wherein said legs have feet extending in a direction radially outward therefrom for attachment to said vessel.

8. The apparatus according to claim 6 wherein said legs are angularly offset to define a tripod support for said apparatus.

9. Apparatus for supporting, in a vessel, a shaft, which carries an impeller of a mixer at one end of the shaft while the shaft is rotatably driven from the end thereof opposite to said one end which comprises a body having a tubular neck, a sleeve having an outer periphery, said sleeve being removably attached in fixed relationship with said neck along its outer periphery, said sleeve having an inner periphery presenting a first bearing surface, a bushing having an outer periphery presenting a second bearing surface and an inner periphery, said bushing being removably attached in fixed relationship with said mixer shaft along its inner periphery adjacent to said one end of said shaft, said first and second bearing surfaces being disposed in contact for steadying said shaft while it rotates while said mixer mixes material in said vessel, an inner neck on said shaft adjacent to said one end thereof, said inner neck being disposed in said body, and said inner neck having means for removably capturing said bushing with said bushing's inner periphery being disposed against and removably attached to said inner neck.

10. The apparatus according to claim 9 wherein said inner neck has a flange defining a step, said bushing having upper and lower ends, said upper end and said step being in contact, said inner neck having a slot, a removable retaining ring removably disposed in said slot and disposed adjacent to said lower end of said bushing, said bushing being axially captured between said step and said retaining ring.

11. The apparatus according to claim 9 wherein said inner neck consists of fiber reinforced plastic material and said first named sleeve is an outer sleeve, said bushing being disposed between said inner and outer sleeves, said outer sleeve being of metalic material.

* * * * *